US006378630B1

(12) United States Patent
Ritorto et al.

(10) Patent No.: US 6,378,630 B1
(45) Date of Patent: Apr. 30, 2002

(54) LOCKING SWIVEL DEVICE

(75) Inventors: Leonardo Ritorto; Robert Roszak, both of Edmonton (CA)

(73) Assignee: Canadian Downhole Drill Systems Inc., Alberta (CA)

( * ) Notice: Subject to any disclaimer, the term of this patent is extended or adjusted under 35 U.S.C. 154(b) by 0 days.

(21) Appl. No.: 09/458,604

(22) Filed: Dec. 10, 1999

(30) Foreign Application Priority Data

Oct. 28, 1999 (CA) ..... 2287-696

(51) Int. Cl.[7] ..... E21B 17/00

(52) U.S. Cl. ..... 175/173; 175/195; 175/202; 175/203; 464/15; 464/19

(58) Field of Search ..... 166/237; 175/162, 175/170, 173, 195, 202, 203; 464/15, 19

(56) References Cited

U.S. PATENT DOCUMENTS 3,606,257 A * 9/1971 Wilson
3,843,096 A * 10/1974 Wilson
4,566,599 A * 1/1986 Villa et al.
4,575,359 A * 3/1986 Berminghan
5,738,178 A * 4/1998 Williams et al.

FOREIGN PATENT DOCUMENTS

| | | |
|---|---|---|
| CA | 2237309 | 8/1998 |
| WO | WO 98/29637 | 7/1998 |

* cited by examiner

*Primary Examiner*—Roger Schoeppel
(74) *Attorney, Agent, or Firm*—Rodman & Rodman

(57) ABSTRACT

A locking swivel device is provided for connection with a proximal end of a drill string and for conducting a drilling fluid to the drill string. The device is comprised of a housing and a mandrel rotatably supported within the housing such that an annular space is defined between the housing and the mandrel, wherein one of the housing and the mandrel is connectable with the drill string such that the drill string rotates therewith. A clutch assembly is positioned within the annular space which is actuatable between an engaged condition in which the clutch assembly engages the housing and the mandrel in order to inhibit the rotation of the mandrel relative to the housing and a disengaged condition in which the clutch assembly disengages the housing and the mandrel in order to permit the rotation of the mandrel relative to the housing. The clutch assembly is actuated to the engaged condition by a pressure exerted by the drilling fluid.

27 Claims, 5 Drawing Sheets

LOCKING SWIVEL DEVICE

FIELD OF INVENTION

The present invention relates to a locking swivel device for connection with a drill string and for conducting a drilling fluid to the drill string. Further, the present invention is directed at a locking swivel device which is actuatable between a disengaged condition, in which the swivel device is unlocked to permit rotation of the drill string, and an engaged condition, in which the swivel device is locked to inhibit rotation of the drill string in at least one direction, and preferably both. The swivel device is actuated to the engaged condition by a pressure exerted by the drilling fluid.

BACKGROUND OF INVENTION

Often during drilling operations, a conventional drilling swivel or swivel mechanism is connected with the drill string at the surface such that the drill string extends from the swivel into the wellbore downhole. The drilling fluid for conducting the drilling operation is conducted from a surface fluid pump through a kelly hose to the swivel. The drilling fluid is then conducted through the swivel and into the attached drill string such that the drilling fluid is directed downhole for performance of the drilling operation.

In addition to conducting the drilling fluid to the drill string, the swivel also supports the drill string in the wellbore in a manner such that the drill string is rotatable within the wellbore. Conventional swivels typically permit rotation of the drill string in either direction within the wellbore. In other words, the drill string may be rotated in either a clockwise or a counterclockwise direction as desired. The ability to rotate the drill string within the wellbore may be desirable for a number of reasons. For instance, the ability to rotate the drill string will facilitate the connection or disconnection of the drill pipe sections comprising the drill string and will facilitate the orienting of the drill string within the wellbore to a desired orientation.

However, conventional swivels often permit the rotation of the drill string in both directions at all times during the drilling operation, including while the drilling fluid is being pumped through the swivel to the drill string. The ability to rotate at all times throughout the drilling operation may not be desirable in a number of applications.

For instance, it is desirable to be able to lock the swivel where the swivel is to be used in conjunction with a downhole positive displacement mud motor. Specifically, the downhole motor is connected with a downhole end of the drill string for drilling the wellbore. Although rotation of the drill string in both directions may be desirable for a number of reasons, including permitting the making up or breaking down of the drill string, rotation of the drill string tends not to be desirable during the actual drilling operation. For instance, when the downhole motor is being operated, the motor creates or generates an amount of reactive torque within the drill string attached thereto. In order to facilitate the drilling operation, it is desirable to hold or otherwise counteract this reactive torque by inhibiting the rotation of the drill string.

Further, it is desirable to be able to lock the swivel in other applications such as where the swivel is placed or located between a rotary top drive unit and the drill string. In this case, locking of the swivel permits rotational movement provided by the top drive unit to be transmitted through the swivel to the drill string. Conversely, unlocking of the swivel inhibits the transmission of the rotational movement. As a result, various operations such as wireline operations may be performed while allowing the drill string to freely rotate.

Thus, there is a need for the swivel to provide a locking mechanism such that the drill string may be selectively either permitted to rotate or inhibited from rotation within the wellbore as required for the particular task being performed. Although various locking swivels have been provided in response to this need, none appear to have provided a fully satisfactory result.

For instance, International Publication Number WO 98/29637 published Jul. 9, 1998 by Helms describes a locking swivel for use in drilling applications which allows the operator to selectively engage and disengage the swivel to permit or inhibit rotational movement of the attached drill string. The locking swivel is comprised of a locking mandrel movable within a lower body and a swivel mandrel. The locking mandrel has splines at each end for engaging splined surfaces provided in both the body and the swivel mandrel. The locking mandrel is movable either up or down and thereby into or out of engagement with the splined surface in the swivel mandrel and the splined surface in the lower body.

A hydraulic chamber is formed between an exterior wall of the locking mandrel and an interior wall of the lower body. A dynamic seal means mounted with the locking mandrel divides the chamber into two sealed portions. Further, two hydraulic fitting ports are provided in the lower body and are disposed on either side of the dynamic seal means. In other words, one hydraulic port communicates with each sealed portion of the hydraulic chamber. The hydraulic fitting ports are connected by standard hydraulic lines to a hydraulic pump.

The locking mandrel is actuated into and out of engagement with the splined surfaces through the use of the hydraulic pump and the two hydraulic fitting ports. If the operator desires to lock the swivel, the operator directs the flow of hydraulic fluid to the first hydraulic fitting port to move the locking mandrel upwards such that the splines of the locking mandrel are engaged with the splined surfaces of the lower body and the swivel mandrel. If the operator desires to unlock the swivel, the operator switches the flow of hydraulic fluid to the second hydraulic fitting port to move the locking mandrel downwards such that the splines of the locking mandrel are disengaged with the splined surfaces of the lower body and the swivel mandrel.

Thus, Helms provides a relatively complex structure for locking and unlocking the swivel which is actuated by and used in conjunction with a separate hydraulic system and hydraulic pump. Further, given the manner of actuating the swivel, Helms requires manual handling or intervention by an operator in order to lock and unlock the swivel. Manual handling or intervention by an operator may be undesirable in some circumstances.

In addition, Canadian Patent Number 2,237,309 issued Jun. 22, 1999 to Brown et. al. is directed at a method and an apparatus for controlling reactive torque on a drill string while drilling. Specifically, a tubular mandrel connected with the drill string is rotatably mounted to a housing. A ratchet mechanism is provided between the mandrel and the housing for controlling the rotation of the mandrel within the housing. The ratchet mechanism permits rotation of the mandrel freely in a clockwise direction and prevents rotation of the mandrel in a counterclockwise direction.

More particularly, the ratchet mechanism is comprised of a ring of sloped ratchet teeth fixed to an exterior surface of the mandrel. A plurality of pins extend through the housing to engage the ratchet teeth. Further, the pins are biased by a spring into an engaged position in which the pins are engaged with the teeth thereby permitting rotation in a clockwise direction and precluding rotation in a counterclockwise direction. Alternately, the pins may be manually retracted from the teeth to a disengaged position in which the mandrel may be rotated in either direction.

Thus, as in Helms Brown et. al. requires manual handling or intervention by an operator in order to unlock or disengage the apparatus, particularly given that the ratchet mechanism is biased to the engaged position. As indicated, manual handling or intervention by an operator may be undesirable in some circumstances.

As a result, there remains a need in the industry for a locking swivel device. In particular, there remains a need for a locking swivel device having a relatively uncomplicated structure. In addition, there remains a need for a swivel device which is actuated without the intervention or manual handling of an operator or other rig personnel.

SUMMARY OF INVENTION

The present invention relates to a locking swivel device for connection with a drill string and for conducting a drilling fluid to the drill string. Further, the present invention relates to a locking swivel device which is actuatable between a disengaged condition, in which the swivel device is unlocked to permit rotation of the drill string relative to the device, and an engaged condition, in which the swivel device is locked to inhibit rotation of the drill string relative to the device.

In the engaged condition, the swivel device may inhibit rotation of the drill string in either or both of a clockwise and a counterclockwise direction relative to the swivel device. In the preferred embodiment, the swivel device inhibits rotation of the drill string in both the clockwise and counterclockwise directions.

Preferably, the swivel device is actuated to the engaged condition by a pressure exerted by the drilling fluid. Further, the swivel device is preferably actuated without the intervention or manual handling of an operator or other rig personnel. In the preferred embodiment, the swivel device is locked or actuated to the engaged condition automatically while the drilling fluid is being conducted by the swivel device to the drill string.

The locking swivel device is provided for connection with a drill string. The swivel device may be connected with the drill string at any location along the length of the drill string between a distal end located or positioned downhole and a proximal end located or positioned uphole at the ground surface. However, the swivel device is preferably connected with the proximal end of the drill string in that the swivel device is connected, attached or affixed with the drill string at, adjacent or in proximity to the proximal end of the drill string such that the swivel device is accessible from the surface during drilling operations.

Further, the swivel device may be connected with a drill string intended for use for either or both rotary or non-rotary drilling. For instance, the swivel device may be connected with a drill string which rotates during the drilling operation for rotary drilling of the wellbore. In this case, a top drive unit may be connected with the swivel device. As a result, locking of the swivel device permits rotational movement provided by the top drive unit to be transmitted through the swivel device to the drill string such that the drill string is rotated within the wellbore. Conversely, unlocking of the swivel device inhibits the transmission of the rotational movement from the top drive unit to the drill string. Preferably, as indicated above, the swivel device is locked or actuated to the engaged condition by the pressure exerted by the drilling fluid being conducted to the drill string to perform the rotary drilling operation.

However, in the preferred embodiment, the swivel device is connected with a drill string which is not intended to rotate during the drilling operation for non-rotary or sliding drilling of the wellbore. In this case, the swivel device of the within invention is intended for use in conjunction with a downhole drilling motor. More particularly, a downhole positive displacement motor is connected with the distal end of the drill string for drilling the wellbore, while the swivel device is connected with the proximal end of the drill string. Again, as indicated above, the swivel device is preferably locked or actuated to the engaged condition by the pressure exerted by the drilling fluid during actuation of the downhole motor by the drilling fluid to perform the drilling operation.

As a result, in the preferred embodiment, the swivel device holds or counteracts the reactive torque created by the downhole motor in the engaged condition while the drilling operation is being performed. Conversely, when the drilling operation is not being performed and drilling fluid is not being conducted through the swivel device and the drill string, the drill string may be rotated relative to the swivel device which permits the making and breaking of threaded drill string connections.

As stated, the swivel device is preferably supported at the surface above the wellbore such that the drill string is supported within the wellbore by the swivel device. The swivel device may be supported at the surface by any mechanism, structure, device or method compatible with the specific drilling operation to be performed. However, preferably, the swivel device is supported at the surface by the drilling rig, and more preferably, by the elevators of the drilling rig.

Further, the drilling fluid may be comprised of any fluid, being a liquid, gas or a mixture thereof, suitable for performing the specific drilling operation. As indicated, the swivel device is preferably used in conjunction with a downhole drilling motor. Thus, the drilling fluid is preferably comprised of a fluid suitable for and capable of operating the downhole motor, such as mud, water, air or a combination thereof.

In a first aspect of the invention, the invention is comprised of a locking swivel device for connection with a proximal end of a drill string and for conducting a drilling fluid to the drill string. The locking swivel device is comprised of:

(a) a housing;

(b) a mandrel rotatably supported within the housing such that an annular space is defined between the housing and the mandrel, wherein one of the housing and the mandrel is connectable with the drill string such that the drill string rotates therewith; and (c) a clutch assembly within the annular space and actuatable between an engaged condition in which the clutch assembly engages the housing and the mandrel in order to inhibit the rotation of the mandrel relative to the housing and a disengaged condition in which the clutch assembly disengages the housing and the mandrel in order to permit the rotation of the mandrel relative to the housing, wherein the clutch assembly is actuated to the engaged condition by a pressure exerted by the drilling fluid.

Further, the clutch assembly is biased towards the disengaged condition. Thus, when the pressure is not being exerted by the drilling fluid, the clutch assembly is actuated to the disengaged condition. Thus, when the swivel device is at rest and the pressure is not being exerted by the drilling fluid, the clutch assembly is in the disengaged condition. Upon the application of the pressure of the drilling fluid, the clutch assembly is actuated to the engaged condition. Finally, upon a release of that pressure, the clutch assembly is urged to return to the disengaged condition.

Thus, the clutch assembly is actuated between the engaged and disengaged conditions by the exertion or lack of exertion of the pressure of the drilling fluid. More particularly, the clutch assembly is designed and configured to be actuated to the engaged condition by the exertion of a predetermined actuation pressure of the drilling fluid. In other words, if the drilling fluid exerts a pressure which i; greater than or equal to the predetermined actuation pressure, the clutch assembly will be actuated to the engaged condition. However, the clutch assembly will be actuated to the disengaged condition when the pressure of the drilling fluid is less than the predetermined actuation pressure.

As indicated, the mandrel is rotatably supported within the housing to permit the rotation of the mandrel relative to the housing. Further, one of the housing and the mandrel is connectable with the drill string such that the drill string rotates therewith. Thru, for instance, the housing may be connectable with the drill string such that rotation of the housing rotates the drill string. In this case, the housing and attached drill string rotate relative to the mandrel. However, preferably, the mandrel is connectable with the drill string such that rotation of the mandrel rotates the drill string. In this case, the mandrel and attached drill string rotate relative to the housing.

In the preferred embodiment, the swivel device is used in conjunction with a downhole motor. Thus, the drill string is preferably inhibited from rotating within the wellbore during the operation of the downhole motor or during drilling of the wellbore. As a result, in the preferred embodiment in which the mandrel is connectable with the drill string, the swivel device is further comprised of an anti-rotation device associated with the housing for inhibiting the rotation of the housing such that the housing is substantially stationary in order that the mandrel is rotatable within the stationary housing when the clutch assembly is disengaged and the mandrel and the housing are substantially stationary or inhibited from rotation when the clutch assembly is engaged. As a result, the drill string connected with the mandrel is rotatable within the wellbore when the clutch assembly is disengaged and the drill string is inhibited from rotation within the wellbore when the clutch assembly is engaged.

Further, the swivel device includes a fluid path for conducting the drilling fluid through the swivel device to the drill string. One or more of the housing, the mandrel or the annular space defined therebetween may define all or a portion of the fluid path for conducting the drilling fluid to the drill string.

Preferably, the mandrel defines a bore which communicates with the drill string in order that the drilling fluid may be conducted through the mandrel to the drill string. In the preferred embodiment, the mandrel has a distal end for connection with the drill string and an opposing proximal end. The bore of the mandrel may extend longitudinally within the mandrel between the proximal and distal ends or for any portion or section thereof. However, preferably, the bore at least extends to the distal end of the mandrel such that the bore of the mandrel communicates with a bore of the drill string at the distal end of the mandrel. In the preferred embodiment, the bore of the mandrel extends between the proximal and distal ends of the mandrel such that the drilling fluid enters the proximal end of the mandrel and is conducted through the mandrel to the distal end.

Further, the housing is preferably comprised of an inlet for conducting the drilling fluid therein, wherein the inlet communicates with the bore of the mandrel and wherein the pressure of the drilling fluid is communicated to the annular space to actuate the clutch assembly. Once the drilling fluid is conducted into the housing by the inlet, the drilling fluid may be conducted or communicated from the inlet to the bore of the mandrel in any manner and by any structure or element comprising the swivel device. Further, the drilling fluid conducted into the housing may enter into or communicate with the bore of the mandrel at any location or position along the length of the bore of the mandrel. However, in the preferred embodiment, the drilling fluid enters into or communicates with the bore of the mandrel at the proximal end of the mandrel.

As stated, the pressure of the drilling fluid is communicated to the annular space to actuate the clutch assembly. The pressure may be directly communicated to the annular space by exposing the annular space to the drilling fluid or the pressure may be indirectly communicated to the annular space by any mechanism or structure capable of transmitting or communicating the pressure from the fluid to the annular space. For instance, a fluid filled chamber may be located between the drilling fluid and the annular space for communicating the pressure of the drilling fluid therethrough.

Preferably, the housing defines a fluid chamber associated with the inlet, wherein the pressure of the drilling fluid within the fluid chamber is communicated to the annular space to actuate the clutch assembly. Again, the pressure may be communicated directly or indirectly. Further, the fluid chamber may be separate or distinct from the fluid path provided for conducting the drilling fluid to the drill string. For instance, a major portion of the drilling fluid may be conducted by the fluid path to the drill string for performance of the drilling operation, while a minor or lesser portion of the drilling fluid is conducted into the fluid chamber such that the pressure of the drilling fluid within the fluid chamber may communicate with the annular space to actuate the clutch assembly.

However, preferably, the fluid chamber forms a part or portion of the fluid path. In the preferred embodiment, the fluid chamber conducts the drilling fluid from the inlet to the bore of the mandrel. Thus, the fluid path of the drilling fluid is comprised of the fluid chamber and the bore of the mandrel such that the drilling fluid is conducted through the inlet into the fluid chamber, from the fluid chamber to the bore of the mandrel and from the bore of the mandrel to the drill string. While the drilling fluid is being conducted through the fluid chamber, the pressure of the drilling fluid within the fluid chamber is communicated to the annular space to actuate the clutch assembly.

The clutch assembly may be comprised of any mechanism, device or structure actuatable between the engaged and disengaged conditions described herein and which may be actuated to the engaged condition by the pressure exerted by the drilling fluid. Further, the clutch assembly may inhibit rotation of the mandrel relative to the housing in either or both of a clockwise and a counterclockwise direction in the engaged condition. For instance, the clutch assembly may inhibit rotation of the mandrel relative to the housing in only one direction in the engaged condition. In this case, the clutch assembly may be comprised of any free-wheeling clutch assembly. However, in the preferred embodiment, the clutch assembly inhibits rotation of the mandrel relative to the housing in both the clockwise and counterclockwise directions.

In the preferred embodiment, the clutch assembly is comprised of a stationary member associated with one of the housing and the mandrel and a dynamic member associated with the other of the housing and the mandrel, wherein the dynamic member is movable within the annular space towards the stationary member for engagement therewith to actuate the clutch assembly to the engaged condition and away from the stationary member for disengagement therefrom to actuate the clutch assembly to the disengaged condition.

As indicated, the stationary member is associated with one of the housing and the mandrel and the dynamic member is associated with the other of the housing and the mandrel. The stationary and dynamic members may be associated with the housing and the mandrel in any manner and by any mechanism or structure permitting the operation of the clutch assembly as described herein. For instance, each of the stationary member and the dynamic member may be connected, mounted, fastened or otherwise affixed with the housing or the mandrel. However, preferably, the stationary member is fixedly mounted with one of the housing and the mandrel and the dynamic member is movably mounted with the other of the housing and the mandrel.

In the preferred embodiment, the stationary member is fixedly mounted with the mandrel and the dynamic member is movably mounted with the housing. Further, in the preferred embodiment, the stationary member defines a bore for receiving the mandrel therein such that the stationary member is mounted about an outer surface of the mandrel. In addition, the dynamic member defines a bore for receiving the mandrel therein such that the dynamic member is positioned about the outer surface of the mandrel and mounted with an inner surface of the housing.

Further, in the preferred embodiment, the pressure of the drilling fluid is communicated to the dynamic member within the annular space such that the pressure exerted by the drilling fluid moves the dynamic member towards the stationary member for engagement therewith. In addition, the dynamic member is preferably biased away from the stationary member such that the dynamic member is moved away from the stationary member for disengagement therefrom when the pressure is not being exerted by the drilling fluid.

In the preferred embodiment, the clutch assembly is further comprised of a biasing device associated with the dynamic member for urging the dynamic member away from the stationary member for disengagement therefrom. The biasing device may be comprised of any device, mechanism or structure capable of urging the dynamic member away from the stationary member. However, in the preferred embodiment, the biasing device is comprised of at least one spring and wherein the spring has a spring force sufficient to urge the dynamic member away from the stationary member to the disengaged condition when the pressure is not being exerted by the drilling fluid.

The stationary member has an engagement surface and the dynamic member has a corresponding engagement surface, wherein the engagement surface of the stationary member is engaged with the engagement surface of the dynamic member in the engaged condition of the clutch assembly such that rotation of the mandrel relative to the housing is inhibited and wherein the engagement surface of the stationary member is disengaged from the engagement surface of the dynamic member in the disengaged condition of the clutch assembly such that rotation of the mandrel relative to the housing is permitted.

The engagement surface of the stationary member and the corresponding engagement surface of the dynamic member may have any shape or configuration able to inhibit, and preferably prevent, the rotation of the mandrel relative to the housing when engaged. However, preferably, the engagement surface of the stationary member defines a plurality of stationary teeth and the engagement surface of the dynamic member defines a plurality of corresponding dynamic teeth compatible with the stationary teeth for engagement therewith.

In addition, the swivel device is preferably comprised of a bearing assembly within the annular space for axially and radially supporting the mandrel within the housing such that the mandrel is rotatable therein. The bearing assembly may be comprised of any device or mechanism capable of axially and radially supporting the mandrel within the housing, such as one or more bearings, bushings or a combination thereof.

In the preferred embodiment, the bearing assembly is comprised of at least one tapered bearing. Preferably the tapered bearing provides both axial and radial support to the mandrel. The tapered bearing may be positioned or mounted within the swivel device in any manner. However, preferably, the mandrel defines a downwardly facing bearing shoulder, the housing defines an upwardly facing bearing shoulder and the tapered bearing is positioned therebetween such that the mandrel is rotatably supported by the housing.

In addition, the tapered bearing is preferably preloaded within the swivel device. Although the tapered bearing may be preloaded in any manner and by any mechanism, structure or device capable of preloading the tapered bearing by a desired preloading force, the tapered bearing is preferably preloaded by the spring force of the spring comprising the biasing device.

Further, in the preferred embodiment, the bearing assembly may be further comprised of at least one radial bearing.

Finally, the swivel device is preferably further comprised of a sealing assembly for sealing the annular space in order to inhibit the entry of the drilling fluid therein. In the preferred embodiment, one or more seals are provided between the dynamic member and the adjacent inner surface of the housing and outer surface of the mandrel such that drilling fluid is inhibited from passing from the fluid chamber into the annular space.

BRIEF DESCRIPTION OF DRAWINGS

Embodiments of the invention will now be described with reference to the accompanying drawings, in which.

DETAILED DESCRIPTION

Figure 2:
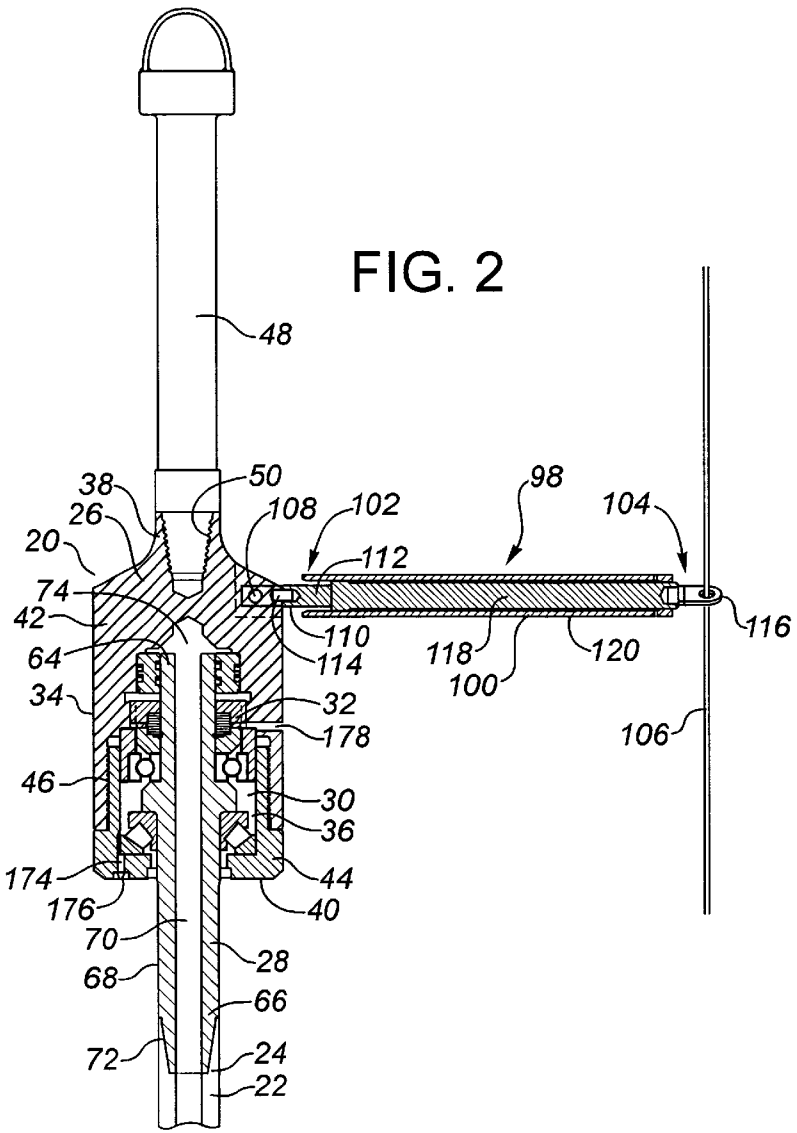
FIG. 2 is a longitudinal sectional view of the locking swivel device taken along lines 2—2 of FIG. 1.

Referring to FIGS. 1–6, the present invention relates to a locking swivel device (20) for connection with a drill string

(22) and for conducting a drilling fluid to the drill string (22). The locking swivel device (20) is actuatable between a disengaged condition, in which the swivel device (20) is unlocked to permit rotation of the drill string (22) relative to the device (20), and an engaged condition, in which the swivel device (20) is locked to inhibit rotation of the drill string (22) relative to the device (20).

As stated, the locking swivel device (20) is provided for connection with the drill string (22). The drill string (22) extends from a proximal end (24) at, adjacent or in proximity to the ground surface to a distal end downhole in a wellbore. The drill string (22) is comprised of one or more pipe sections which are connected together by threaded connections. The drill string (22) is provided for performance of a drilling operation, and specifically, for drilling of the wellbore. Although the swivel device (20) may be located at any position along the length of the drill string (22) between its proximal and distal ends (24, 26), the swivel device (20) is preferably connected with the proximal end (24) of the drill string (22). Thus, the device (20) is accessible from the surface and is provided to support the drill string (22) within the wellbore.

Further, in the preferred embodiment, the swivel device (20) is used in conjunction with a downhole drilling motor, such as a downhole positive displacement motor. In this instance, the proximal end (24) of the drill string (22) is connected with the swivel device (20) and the distal end of the drill string (22) is connected with the downhole motor. As described further below, in the preferred embodiment, the swivel device (20) holds or counteracts the reactive torque created in the drill string (22) by operation of the downhole motor when the device (20) is locked or in the engaged condition. Thus, the drill string (22) is inhibited from rotation in the wellbore. Conversely, the drill string (22) may be rotated within the wellbore when the device (20) is unlocked or in the disengaged condition in order to permit the making and breaking of the threaded connections between the pipe sections comprising the drill string (22).

Further, as stated, the swivel device (20) conducts a drilling fluid to the drill string (22). This drilling fluid (22) is preferably used for performance of the drilling operation. Thus, in the preferred embodiment, the drilling fluid is conducted through the swivel device (20), as described below, to the proximal end (24) of the drill string (22) connected therewith, and is then conducted through the drill string (22) downhole to its distal end for operation of the downhole drilling motor. The drilling fluid may be supplied to the swivel device (20) in any manner and by any device, structure, mechanism or method capable of supplying the drilling fluid. In the preferred embodiment, the drilling fluid is supplied to the device (20) at the surface by a fluid pump connected with the device (20).

The drilling fluid may be comprised of any fluid, being a liquid, gas or a mixture thereof, suitable for performing the specific drilling operation. Thus, in the preferred embodiment, the drilling fluid is comprised of a fluid, being a liquid, gas or a mixture thereof, suitable for and capable of actuating the downhole drilling motor in order to perform the drilling operation within the wellbore. More particularly, the drilling fluid is preferably comprised of drilling mud, water or a combination thereof.

In order to perform the drilling operation, the swivel device (20) is preferably supported at the ground surface above the wellbore such that the drill string (22) is supported within the wellbore by the swivel device (20) connected at its proximal end (24). The swivel device (20) may be supported at the surface by any mechanism, structure, device or method suitable for supporting the drill string (22) in the desired manner to permit the performance of the drilling operation. However, in the preferred embodiment, the swivel device (20) is supported by the drilling rig. Although the device (20) may be supported by any component or element of the drilling rig located at the surface for performing the drilling operation, the device (20) is preferably supported by the elevators of the drilling rig. The specific connection with the rig's elevators is described below.

The locking swivel device (20) it comprised of a housing (26) and a mandrel (28) rotatably supported within the housing (26). Thus, the mandrel (28) is permitted to rotate relative to the housing (26). Further, the mandrel (28) is supported within the housing (26) such that an annular space (30) is defined or provided between the housing (26) and the mandrel (28). The annular space (30) preferably extends about the entire outer circumference of the mandrel (28). However, as discussed further below, the size and configuration of the annular space (30) need not be uniform throughout.

In addition, the swivel device (20) is comprised of a clutch assembly (32) within the annular space (30) which is actuatable between an engaged condition and a disengaged condition. In the engaged condition, the clutch assembly (32) engages the housing (26) and the mandrel (28) in order to inhibit the rotation of the mandrel (28) relative to the housing (26). In the disengaged condition, the clutch assembly (32) permits the rotation of the mandrel (28) relative to the housing (26).

As discussed further below, in the engaged condition, the clutch assembly (32) may inhibit rotation in either or both a clockwise and a counterclockwise direction. However, in the preferred embodiment, the clutch assembly (32) inhibits the rotation of the mandrel (28) relative to the housing (26) in both directions.

Finally, the swivel device (20) includes a fluid path for conducting the drilling fluid through the swivel device (20) to the drill string (22). One or more of the housing (26), the mandrel (28) or the annular space (30) defined therebetween may define all or a portion of the fluid path for conducting the drilling fluid to the drill string (22).

Referring to FIGS. 1–4, the housing (26) has an outer surface (34), an inner surface (36), a proximal end (38) and an opposed distal end (40). The housing (26) may be comprised of a single element or unit or it may be comprised of two or more sections or elements connected, affixed or mounted together to form the housing (26). In the preferred embodiment, in order to facilitate the assembly of the swivel device (20), the housing (26) is comprised of a proximal section (42) and a distal section (44). The proximal section (42) comprises the proximal end (38) of the housing (26), while the distal section (44) comprises the distal end (40) of the housing (26).

The proximal section (42) of the housing (26) may be connected, affixed, fastened or mounted with the distal section (44) by any mechanism, structure, device or method capable of connecting, affixing, fastening or mounting the sections (42, 44) together to form the housing (26). However, preferably, a threaded connection (46) is provided between the proximal and distal sections (42, 44).

The proximal end (38) of the housing (26) is connectable with the drilling rig such that the housing (26) of the swivel device (20) is supported thereby. The proximal end (38) may be connected with the drilling rig in any manner and by any mechanism, structure, device or method permitting the housing (26), and thus the device (20), to be supported above the wellbore in which the drilling operation is to occur. However, in the preferred embodiment, the proximal end (38) is connected with a fishing neck (48) which is suspended by the elevators of the drilling rig. The proximal end (38) may be connected with the fishing neck (48) by any mechanism, structure, device or method capable of connecting, affixing, fastening or mounting the proximal end (38) of the housing (26) with the fishing neck (48). However, in the preferred embodiment, a threaded connection (50) is provided between the proximal end (38) and the fishing neck (48).

Further, the housing (26) is comprised of an inlet (52) for conducting the drilling fluid into the housing (26). More particularly, the inlet (52) conducts the drilling fluid from outside the housing (26) into the housing (26) such that the drilling fluid enters the fluid path defined by the swivel device (20) in order that the drilling fluid may pass through the swivel device (20) to the drill string (22). In the preferred embodiment, the inlet (52) extends from the outer surface (34) of the housing (26) to the inner surface (36) of the housing (26). Further, the inlet (52) may be located at any position alone the outer surface (34) between the proximal and distal ends (38, 40) of the housing (26), however, the inlet (52) is preferably located or positioned at, adjacent or in proximity to the proximal end (38).

Figure 1:
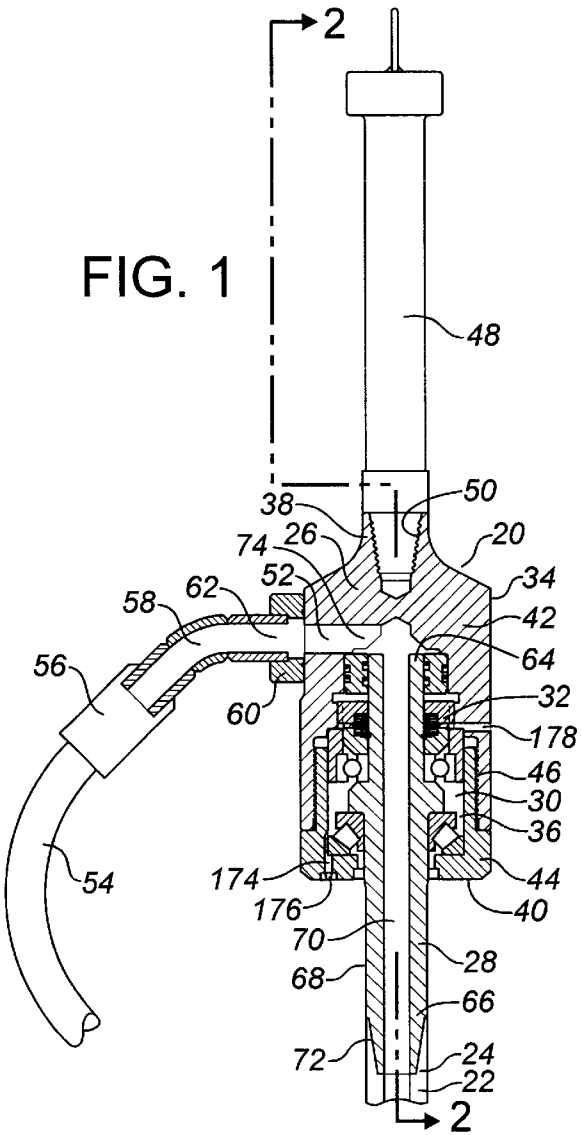
FIG. 1 is a longitudinal sectional view of a preferred embodiment of a locking swivel device of the within invention.
Figure 3:
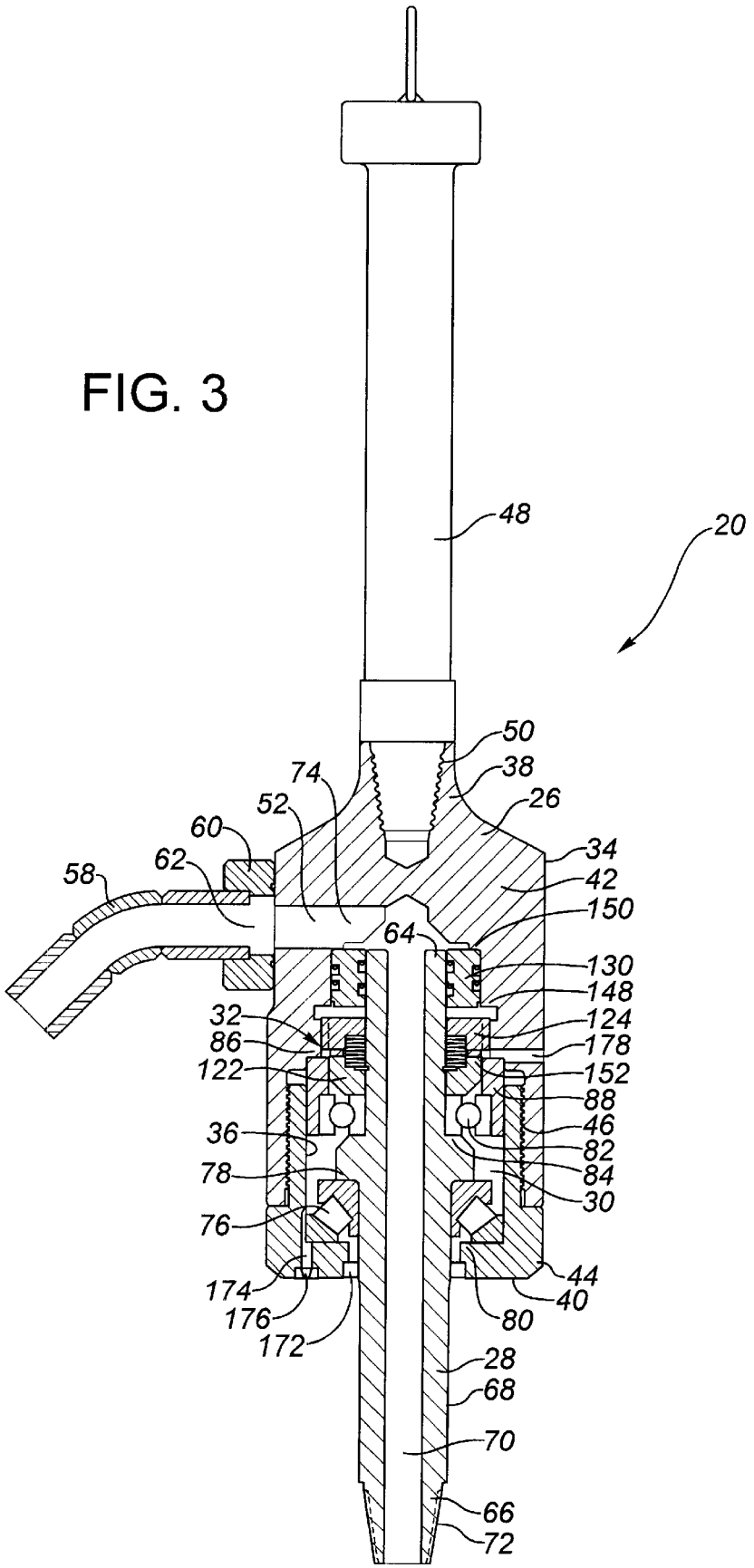
FIG. 3 is a more detailed longitudinal sectional view of the locking swivel device shown in FIG. 1.

The inlet (52) of the housing (26) is connectable with a source or a supply of the drilling fluid. As indicated above, the drilling fluid may be supplied to the swivel device (20) in any manner and by any device, structure, mechanism or method capable of supplying the drilling fluid. In the preferred embodiment, the drilling fluid is supplied to the device (20) at the surface by a fluid pump connected with the inlet (52) of the housing (26). More particularly, as shown in FIGS. 1 and 3, a hose (54), such as a kelly hose, extends from the fluid pump to a connection end (56) for connection with the inlet (52). The connection end (56) of the kelly hose (54) may be connected with the inlet (52) directly on indirectly in any manner and by any mechanism, structure or device permitting the drilling fluid to pass from the hose (54) into the housing (26) through the inlet (52). In the preferred embodiment, the connection end (56) of the kelly hose (54) is connected with the inlet (52) by a gooseneck (58) and a flange (60).

Specifically, the flange (60) is mounted, attached or affixed with the outer surface (34) of the housing (26) at the inlet (52) and defines a bore (62) extending therethrough such that the drilling fluid may be conducted through the bore (62) to the inlet (52). Preferably, the flange (60) is mounted or affixed with the outer surface (34) of the housing (26) such that a sealed is formed therebetween. Further, the gooseneck (58) extends from the connection end (56) of the kelly hose (54) to the flange (60), and is preferably received within the bore (62). As well, the connection end (56) is preferably mounted, attached or affixed with the flange (60), preferably within the bore (62), such that a sealed is formed therebetween. As a result, the drilling fluid is conducted through the kelly hose (54) to the gooseneck (58), through the gooseneck (58) to the flange (60) and through the bore (62) of the flange (60) to the inlet (52) of the housing (26).

As indicated, the mandrel (28) is rotatably supported within the housing (26). Referring to FIGS. 1–4, the mandrel (28) has a proximal end (64) and an opposed distal end (66). Further, the mandrel (28) has an outer surface (68) and preferably defines a longitudinal bore (70) therein. The mandrel (28) may be comprised of a single element or unit or it may be comprised of two or more sections or elements connected, affixed or mounted together to form the mandrel (28). In the preferred embodiment, the mandrel (28) is comprised of a single element or unit providing the proximal and distal ends (64, 66).

The drill string (22) may be connected with either the housing (26) or the mandrel (28) such that the drill string rotates therewith. For instance, the housing (26) may be connectable with the drill string (22) such that rotation of the housing (26) rotates the drill string (22). Thus, the housing (26) and attached drill string (22) may rotate relative to the mandrel (28).

However, in the preferred embodiment, the mandrel (28) is connectable with the drill string (22) such that rotation of the mandrel (28) rotates the drill string (22). Thus, the mandrel (28) and attached drill string (22) rotate relative to the housing (26). The drill string (22) may be connected with the mandrel (28) at any location or position along the length of the mandrel (28) and by any mechanism, structure, device or method such that rotation of the mandrel (28) results in a corresponding rotation of the drill string (22).

However, in the preferred embodiment, the distal end (66) of the mandrel (28) is connectable with the drill string (22). More particularly, the distal end (66) of the mandrel (28) is connectable with the proximal end (24) of the drill string (22). Further, the distal end (66) is preferably connectable with the proximal end (24) of the drill string (22) by a threaded connection (72) therebetween, as shown in FIGS. 1 and 2.

The mandrel (28) need not define a bore (70) therein for conducting the drilling fluid. Rather, the drilling fluid may be conducted to the drill string (22) by a fluid path provided or defined by one or both of the annular space (30) and the housing (26). However, preferably, the mandrel (28) defines the bore (70) in order that the drilling fluid may be conducted therethrough. Thus, preferably, the fluid path through the swivel device (20) is comprised of the bore (70) of the mandrel (28). Further, the inlet (52) of the housing (26) communicates with the bore (70) of the mandrel (28) such that the drilling fluid is conducted from the inlet (52) to the bore (70).

The bore (70) may extend longitudinally within the mandrel (28) between the proximal and distal ends (64, 66) or for any portion or section thereof. However, preferably, the bore (70) at least extends to the distal end (66) of the mandrel (28) such that the bore (70) of the mandrel (28) communicates with a bore of the drill string (22) at the distal end (66) of the mandrel (28). For instance, the drilling fluid may enter the bore (70) of the mandrel (28) at any location or position along the length of the mandrel (28) and exit the bore (70) at the distal end (66) of the mandrel (28).

However, in the preferred embodiment, the bore (70) of the mandrel (28) extends between the proximal and distal ends (64, 66) of the mandrel (28). Accordingly, the drilling fluid is conducted form the inlet (52) of the housing (26) to the proximal end (64) of the mandrel (28). The drilling fluid then enters the proximal end (64) of the mandrel (28) and is conducted through the mandrel (28) to the distal end (66). At the distal end (66), the drilling fluid exits the mandrel (28) and enters the proximal end (24) of the drill string (22).

Further, the inlet (52) of the housing (26) may communicate with the bore (70) of the mandrel (28), preferably at the proximal end (64) of the mandrel (28), in any manner and by any structure, mechanism, device or method able to conduct the drilling fluid from the inlet (52) to the bore (70). For instance, in addition to the bore (70) of the mandrel (28), the fluid path of the swivel device (20) may be further comprised of one or both of the housing (26) and the annular space (30). Specifically, one or both of the housing (26) and the annular space (30) may conduct the drilling fluid from the inlet (52) of the housing (26) to the bore (70) of the mandrel (28).

Preferably, the housing (26) defines a fluid chamber (74) associated with the inlet (52) of the housing (26). As discussed further below, this fluid chamber (74) may not comprise the fluid path through the swivel device (20). However, in the preferred embodiment, the fluid path is comprised of the fluid chamber (74). More particularly, the fluid chamber (74) conducts the drilling fluid from the inlet (52) to the bore (70) of the mandrel (28). Thus, the fluid path through the swivel device (20) is comprised of the fluid chamber (74) and the bore (70) of the mandrel (28). The drilling fluid enters the housing (26) through the inlet (52) and is received within the fluid chamber (74). The fluid chamber (74) conducts the drilling fluid to the proximal end (64) of the mandrel (28) where it enters the bore (70) of the mandrel (28). Finally, the drilling fluid is conducted through the bore (70) of the mandrel (28) and out of its distal end (66) for passage into the drill string (22).

As stated, the mandrel (28) is rotatably supported within the housing (26). The mandrel (28) may be positioned relative to the housing (26) in any manner permitting the rotation of the mandrel (26) relative to the housing (26). However, preferably, the proximal end (64) of the mandrel (28) is located within the housing (26). Further, in the preferred embodiment, the proximal end (64) of the mandrel (28) is positioned in proximity to the proximal end (38) of the housing (26) in communication with the fluid chamber (74).

The distal end (66) of the mandrel (28) may similarly be positioned within the housing (26). However, preferably, the distal end (66) of the mandrel (28) extends or protrudes from the distal end (40) of the housing (26) in order to facilitate the connection of the drill string (22) thereto.

Further, the mandrel (28) is rotatably supported within the housing (26) such that the annular space (30) is defined between the mandrel (28) and the housing (26). More particularly, the annular space (30) is defined between the outer surface (68) of the mandrel (28) and the inner surface (36) of the housing (26). Thus, the annular space (30) extends circumferentially about the entire outer surface (68) of the mandrel (28). Further, the annular space (30) may extend longitudinally or axially along any portion or length of the mandrel (28) located within the housing (26). In the preferred embodiment, the annular space (30) extends longitudinally or axially substantially between the proximal end (64) of the mandrel (28) and the location at which the mandrel (28) exits or passes out of or from the housing (26).

In addition, the shape or configuration of the annular space (30) may vary both circumferentially about the outer surface (68) of the mandrel (28) and longitudinally or axially along the length of the mandrel (28). For instance, the radial distance between the inner surface (36) of the housing (26) and the outer surface (68) of the mandrel (28) may vary. In particular, the radial distance may vary as required to accommodate the clutch assembly (32) and other components of the swivel device (20) within the annular space (30).

The mandrel (28) may be supported within the housing (26) by any mechanism, structure, device or method permitting the rotation of the mandrel (28) relative to the housing (26). However, preferably, the swivel device (20) is comprised of a bearing assembly within the annular space (30). The bearing assembly axially or longitudinally supports the mandrel (28) within the housing (26) such that the mandrel (28) is held longitudinally or axially in the desired position within the housing (26) and such that the mandrel (28) is rotatable therein. In addition, the bearing assembly also preferably radially supports the mandrel (28) within the housing (26) such that the mandrel (28) is held radially in the desired position within the housing (26). In the preferred embodiment, the bearing assembly radially supports the mandrel (28) such that the mandrel (28) is maintained substantially centrally within the housing (26) and such that the mandrel (28) is permitted to rotate with a concentric motion.

Thus, the bearing assembly is comprised of any device, mechanism or structure capable of bearing axial loads such that the mandrel (28) is axially supported within the housing (26). Preferably, the bearing assembly is further comprised of any device, mechanism or structure capable of bearing radial loads such that the mandrel (28) is radially supported within the housing (26). In the preferred embodiment, the bearing assembly is comprised of one or more bearings, bushings or a combination thereof.

More particularly, in the preferred embodiment, the bearing assembly is comprised of a tapered bearing (76). Preferably the tapered bearing (76) provides both axial and radial support to the mandrel (28). The tapered bearing (76) may be mounted, fastened, positioned or otherwise held between the mandrel (28) and the housing (26) within the annular space (30) in any manner and by any mechanism, structure, device or method such that the tapered bearing (76) axially and radially supports the mandrel (28) within the housing (26). Further, the tapered bearing (76) may be located at any position along the length of the mandrel (28) within the annular space (30).

However, preferably, the outer surface (68) of the mandrel (28) defines a downwardly facing bearing shoulder (78). In addition, the inner surface (36) of the housing (26) defines an upwardly facing bearing shoulder (80) opposing the downwardly facing bearing shoulder (78) of the mandrel (28). In the preferred embodiment, the upwardly facing bearing shoulder (80) is defined by, or located at, adjacent or in proximity to, the distal end (40) of the housing (26). The tapered bearing (76) is positioned between the upwardly facing bearing shoulder (80) and the opposed downwardly facing bearing shoulder (78) such that it is held therebetween. As a result, the mandrel (28) is rotatably supported within the housing (26) by the tapered bearing (76).

The tapered bearing (76) is preferably preloaded within the annular space (30). Although the tapered bearing (76) may be preloaded in any manner and by any mechanism, structure or device capable of preloading the tapered bearing (76) by a desired preloading force, the tapered bearing (76) is preferably preloaded by a spring as described further below.

In the preferred embodiment, the bearing assembly is further comprised of at least one radial bearing (82) within the annular space (30). The radial bearing (82), preferably a radial ball bearing, provides further radial support to the mandrel (28) within the housing (26). The radial bearing (82) may be mounted, fastened, positioned or otherwise held between the mandrel (28) and the housing (26) within the annular space (30) in any manner and by any mechanism, structure, device or method such that the radial bearing (82) radially supports the mandrel (28) within the housing (26). Further, the radial bearing (82) may be located at any position along the length of the mandrel (28) within the annular space (30).

However, preferably, the outer surface (68) of the mandrel (28) defines an upwardly facing bearing shoulder (84). In addition, the inner surface (36) of the housing (26) defines a downwardly facing bearing shoulder (86) opposing the upwardly facing bearing shoulder (84) of the mandrel (28). The radial bearing (82) is positioned between the upwardly facing bearing shoulder (84) and the opposed downwardly facing bearing shoulder (86) such that it is held therebetween.

In the preferred embodiment, the radial bearing (82) is contained within a bearing housing (88) positioned within the annular space (30). The bearing housing (88) has an inner surface (90), a proximal end (92) and a distal end (94). More particularly, referring to FIGS. 5 and 6, the bearing housing (88) is positioned about the radial bearing (82) such that the radial bearing (82) is located between the inner surface (90) of the bearing housing (88) and the outer surface (68) of the mandrel (28). Further, the inner surface (90) of the bearing housing (88) defines a downwardly facing bearing shoulder (96) such that the radial bearing (82) is positioned between the downwardly facing bearing shoulder (96) of the bearing housing (88) and the upwardly facing bearing shoulder (84) of the mandrel (28). In addition, the proximal end (92) of the bearing housing (88) abuts against the downwardly facing bearing shoulder (86) of the housing (26). As a result, the bearing housing (88) and the radial bearing (82) contained therein are maintained in position within the annular space (30) between the upwardly facing bearing shoulder (84) of the mandrel (28) and the opposed downwardly facing bearing shoulder (86) of the housing (26).

As indicated previously, in the preferred embodiment, the swivel device (20) is used in conjunction with a downhole motor. Thus, the drill string (22) is preferably inhibited from rotating within the wellbore during the operation of the downhole motor or during drilling of the wellbore. As a result, in the preferred embodiment in which the mandrel (28) is connectable with the drill string (22), the swivel device (20) is further comprised of an anti-rotation device (98) associated with the housing (26) for inhibiting the rotation of the housing (26).

As a result, when the clutch assembly (32) is disengaged, the housing (26) is inhibited from rotation such that the housing (26) is substantially stationary while the mandrel (28) is rotatable within the stationary housing (26). When the clutch assembly (32) is engaged, both the mandrel (28) and the housing (28) are inhibited from rotation such that both the mandrel (28) and the housing (26) are substantially stationary. Thus, the drill string (22) connected with the mandrel (28) is rotatable within the wellbore when the clutch assembly (32) is disengaged and the drill string (22) is inhibited from rotation within the wellbore when the clutch assembly (32) is engaged.

The anti-rotation device (98) may be comprised of any structure, device or mechanism mounted, connected, fastened, affixed or otherwise associated with the housing (26) which is capable of inhibiting the rotation of the housing (26), particularly when the clutch assembly (32) is in the engaged condition. However, referring to FIGS. 2 and 4, in the preferred embodiment, the anti-rotation device (98) is comprised of a torque arm (100).

Figure 4:
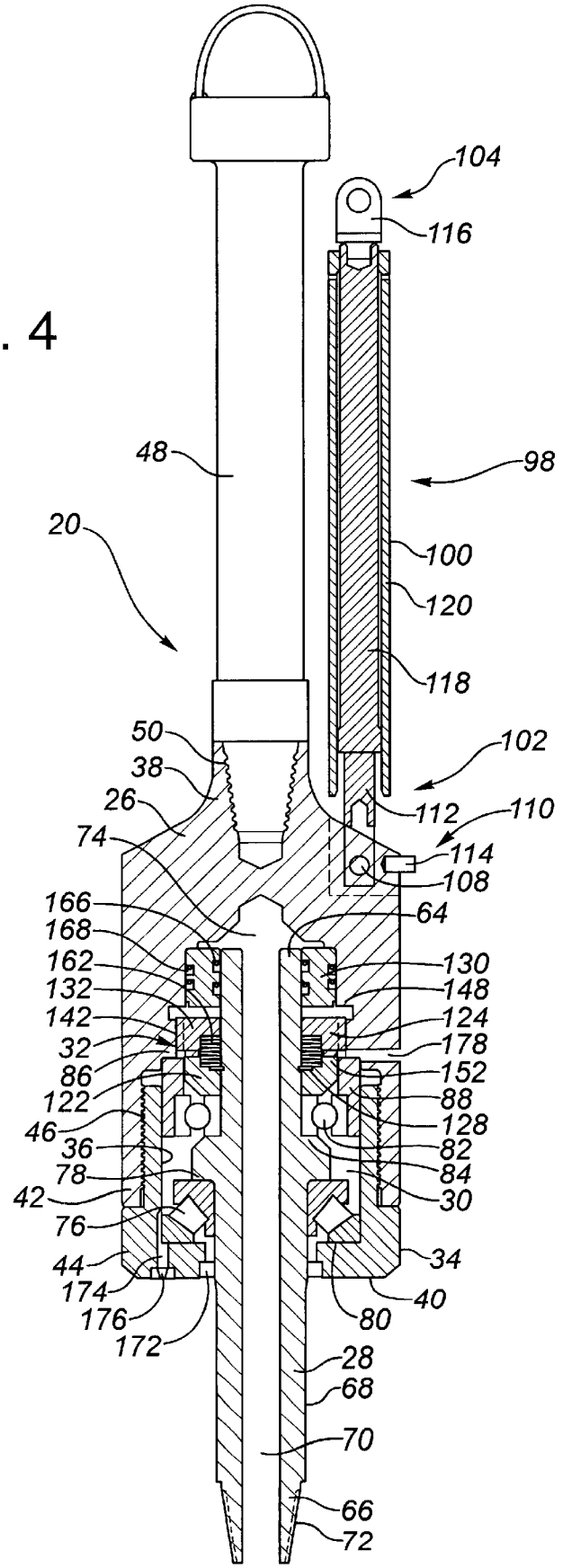
FIG. 4 is a more detailed longitudinal sectional view of the locking swivel device shown in FIG. 2.

Referring to FIGS. 2 and 4, the torque arm (100) has a first end (102) and a second end (104). The first end (102) is connected, mounted, affixed, fastened or otherwise attached with the housing (26), preferably the outer surface (34) of the housing (26). The second end (104) is connected, mounted, affixed, fastened or otherwise attached with the drilling rig. Preferably, the second end (104) is connected with an anchor line (106), preferably the sand line of the drilling rig. Thus, the torque arm (100) extends between the housing (26) and the anchor line (106) to prevent or inhibit rotation of the housing (26).

In the preferred embodiment, the first end (102) is pivotally mounted with the outer surface (34) of the housing (26) to facilitate the assembly and positioning of the swivel device (20) within the drilling rig and the transportation of the swivel device (20). Although the first end (102) may be pivotally mounted by any mechanism, structure or device permitting the pivoting of the torque arm (100) about the first end (102), the first end (102) is preferably mounted by a pivot pin (108). As a result, the torque arm (100) may be pivoted about the pivot pin (108) to its desired position relative to the housing (26).

The torque arm (100) may be pivoted about the pivot pin (108) to any desired position relative to the housing (26). However, preferably, the torque arm (100) is pivoted until it is about perpendicular to the outer surface (34) of the housing (26) as shown in FIG. 2. Once the desired position is achieved, preferably the torque arm (100) is retained or maintained in that desired position by a locking device (110). Any locking device (110) capable of retaining or maintaining the torque arm (100) in its desired position relative to the housing (26) may be used.

In the preferred embodiment, the locking device (110) is comprised of an arm bracket (112) mounted, connected, attached, fastened, affixed or otherwise associated with the first end (102) of the torque arm (100). The locking device (100) is further comprised of a bushing (114) mounted, connected, attached, fastened, affixed or otherwise associated with the outer surface (34) of the housing (26) and which is compatible with the arm bracket (112). Specifically, as shown in FIG. 2, the bushing (114) is received within the arm bracket (112) when the torque arm (100) is moved to the desired position. As a result, further pivoting of the torque arm (100) is inhibited.

Further, in the preferred embodiment, the second end (104) is slidably connected with the anchor line (106) such that the second end (104) is slidable along the anchor line (106) during use of the swivel device (20). Although the second end (104) may be slidably connected by any mechanism, structure or device permitting the second end (104) to slide along the anchor line (106), preferably the second end (104) is comprised of an eye pin (116). Specifically, the anchor line (106) extends through the eye pin (116) which is sized to permit the anchor line (106) to freely move or slide therethrough.

In addition, the length of the torque arm (100) between the first and second arms (102, 104) is preferably variable in order to accommodate variations in the distance between the swivel device (20) and the anchor line (106). The length of the torque arm (100) may be varied in any manner and by any mechanism, structure, device or method permitting the distance between the first and second ends (102, 104) to be varied. However, in the preferred embodiment, the torque arm (100) is comprised of a sliding section (118) telescopically received within a fixed section (120). Thus, the sliding section (118) reciprocates within the fixed section (120) to achieve the desired length of the torque arm (100).

The sliding section (118) may be associated with either one of the housing (26) and the anchor line (106), while the fixed section (120) is associated with the other of the housing (26) and the anchor line (106). However, preferably, the sliding section (118) is associated with the anchor line (106) and comprises the second end (104) of the torque arm (100), while the fixed section (120) is associated with the outer surface (34) of the housing (26) and comprises the first end (102) of the torque arm (100).

As discussed previously, the clutch assembly (32) of the swivel device (20) is located within the annular space (30) and is actuatable between the engaged condition and the disengaged condition. In the engaged condition, the clutch assembly (32) engages the housing (26) and the mandrel (28) in order to inhibit the rotation of the mandrel (28) relative to the housing (26). In the disengaged condition, the clutch assembly (32) permits the rotation of the mandrel (28) relative to the housing (26).

The clutch assembly (32) is actuated to the engaged condition by a pressure exerted by the drilling fluid. Further, the clutch assembly (32) is preferably biased towards the disengaged condition. Thus, when the pressure is not being exerted by the drilling fluid, the clutch assembly (32) is actuated to the disengaged condition. Thus, when the swivel device (20) is at rest and the pressure is not being exerted by the drilling fluid and thus is not being communicated to the clutch assembly (32), the clutch assembly (32) is in the disengaged condition. Upon the application of the pressure of the drilling fluid or the communication of the pressure of the drilling fluid to the clutch assembly (32), the clutch assembly (32) is actuated to the engaged condition. Finally, upon a release of that pressure, the pressure of the drilling fluid is once again not communicated to the clutch assembly (32) and the clutch assembly (32) is urged to return to the disengaged condition.

Thus, the clutch assembly (32) is actuated between the engaged and disengaged conditions by the exertion or lack of exertion of the pressure of the drilling fluid. In other words, the clutch assembly (32) is actuated between the engaged and disengaged conditions by the communication or lack of communication of the pressure of the drilling fluid to the clutch assembly (32).

In the preferred embodiment, the clutch assembly (32) is actuated to the engaged condition by the exertion or communication of a predetermined actuation pressure of the drilling fluid. Further, the clutch assembly (32) is biased towards the disengaged condition by a biasing force. The magnitude of the predetermined actuation pressure and the biasing force are selected or predetermined such that the actuation pressure of the drilling fluid is sufficient to overcome or counteract the biasing force and thus actuate the clutch assembly (32) to the engaged condition.

In other words, if the drilling fluid exerts a pressure which is greater than or equal to the predetermined actuation pressure, the pressure will overcome the biasing force and the clutch assembly (32) will be actuated to the engaged condition. However, when the pressure of the drilling fluid is less than the predetermined actuation pressure, the biasing force is effective and the clutch assembly (32) is actuated to the disengaged condition.

The pressure of the drilling fluid is communicated to the annular space (30) to actuate the clutch assembly (32). The pressure may be directly communicated to the annular space (30), and thus the clutch assembly (32), by exposing the annular space (30) to the drilling fluid. Alternately, the pressure of the drilling fluid may be indirectly communicated to the annular space (30), and thus the clutch assembly (32), by any mechanism, structure, device or process capable of transmitting or communicating the pressure from the fluid to the annular space (30) and the clutch assembly (32) therein. For instance, a fluid filled chamber may be positioned between the drilling fluid and the annular space (30) for communicating the pressure of the drilling fluid therethrough.

Preferably, the pressure of the drilling fluid is communicated directly to the annular space (30) and the clutch assembly (32) therein. Further, the drilling fluid is conducted into the swivel device (20) through the inlet (52). The drilling fluid conducted through the inlet (52) may communicate the pressure to the annular space (30) and the clutch assembly (32) therein in any manner and at any location or position within the swivel device (20). For instance, the drilling fluid being conducted through the swivel device (20) along the fluid path described herein may communicate the pressure at any location or point along that fluid path. Alternately, an amount of drilling fluid separate and apart from the fluid path may communicate the pressure.

However, as described above, the housing (26) preferably defines a fluid chamber (74) associated with the inlet (52) of the housing (26). Preferably, the pressure of the drilling fluid within the fluid chamber (74) is communicated to the annular space (30) to actuate the clutch assembly (32). The fluid chamber (74) may not comprise the fluid path through the swivel device (20). Rather, the fluid chamber (74) may be separate and apart or distinct from the fluid path provided for conducting the drilling fluid through the swivel device (20) to the drill string (22). For instance, a first portion of the drilling fluid may be conducted by the fluid path through the swivel device (20) to the drill string (22) for performance of the drilling operation, while a second portion of the drilling fluid is conducted into the fluid chamber (74) such that the pressure of the drilling fluid within the fluid chamber (74) is communicated to the annular space (30) to actuate the clutch assembly (32).

However, in the preferred embodiment, the fluid path is comprised of the fluid chamber (74). As described, the fluid chamber (74) conducts the drilling fluid from the inlet (52) to the bore (70) of the mandrel (28). Thus, the fluid path through the swivel device (20) is comprised of the fluid chamber (74) and the bore (70) of the mandrel (28). While the drilling fluid is being conducted along the fluid path through the fluid chamber (74), the pressure of the drilling fluid within the fluid chamber (74) is communicated to the annular space (30) to actuate the clutch assembly (32).

The clutch assembly (32) may be comprised of any mechanism, device or structure actuatable between the engaged and disengaged conditions described herein and which may be actuated to the engaged condition by the pressure exerted by the drilling fluid. However, referring to FIGS. 5 and 6, preferably, the clutch assembly (32) is comprised of a stationary member (122) and a dynamic member (124). The stationary member (122) is associated with one of the housing (26) and the mandrel (28), while the dynamic member (124) is associated with the other of the housing (26) and the mandrel (28). More particularly, the stationary member (122) is associated with one of the inner surface (36) of the housing (26) and the outer surface (68) of the mandrel (28), while the dynamic member (124) is associated with the other of the inner surface (36) of the housing (26) and the outer surface (68) of the mandrel (28).

In any event, the associations are such that the dynamic member (124) is movable within the annular space (30) towards the stationary member (122) for engagement therewith to actuate the clutch assembly (32) to the engaged condition and such that the dynamic member (124) is movable away from the stationary member (122) for disengagement therefrom to actuate the clutch assembly (32) to the disengaged condition. Preferably, the stationary member (122) is fixedly mounted, connected, fastened, affixed or otherwise associated with one of the inner surface (36) of the housing (26) and the outer surface (68) of the mandrel (28), while the dynamic member (124) is movably mounted, connected, fastened, affixed or otherwise associated with the other of the inner surface (36) of the housing (26) and the outer surface (68) of the mandrel (28).

In the preferred embodiment, the pressure of the drilling fluid is communicated to the dynamic member (124) within the annular space (30) such that the pressure exerted by the drilling fluid moves the dynamic member (124) towards the stationary member (122) for engagement therewith. In addition, the dynamic member (124) is biased away from the stationary member (122) such that the dynamic member (124) is moved away from the stationary member (122) for disengagement therefrom when the pressure is not being exerted by the drilling fluid.

Thus, the clutch assembly (32) is actuated between the engaged and disengaged conditions by the communication or lack of communication of the pressure of the drilling fluid to the dynamic member (124). More particularly, in the preferred embodiment, the clutch assembly (32) is actuated to the engaged condition by the communication of the predetermined actuation pressure of the drilling fluid to the dynamic member (124). Further, the dynamic member (124) is biased away from the stationary member (122) towards the disengaged condition by the biasing force.

Thus, if the drilling fluid exerts a pressure on the dynamic member (124) which is greater than or equal to the predetermined actuation pressure, the pressure will overcome the biasing force and the dynamic member (124) will be moved towards the stationary member (122) for engagement therewith. However, when the pressure of the drilling fluid is less than the predetermined actuation pressure, the biasing force is effective and the dynamic member (124) is moved away from the stationary member (122) for disengagement therefrom.

The pressure of the drilling fluid is communicated to the dynamic member (124) within the annular space (30) in order to move the dynamic member (124) and thus to actuate the clutch assembly (32). In the preferred embodiment, the pressure of the drilling fluid within the fluid chamber (74) is communicated to the dynamic member (124) within the annular space (30).

Figure 5:
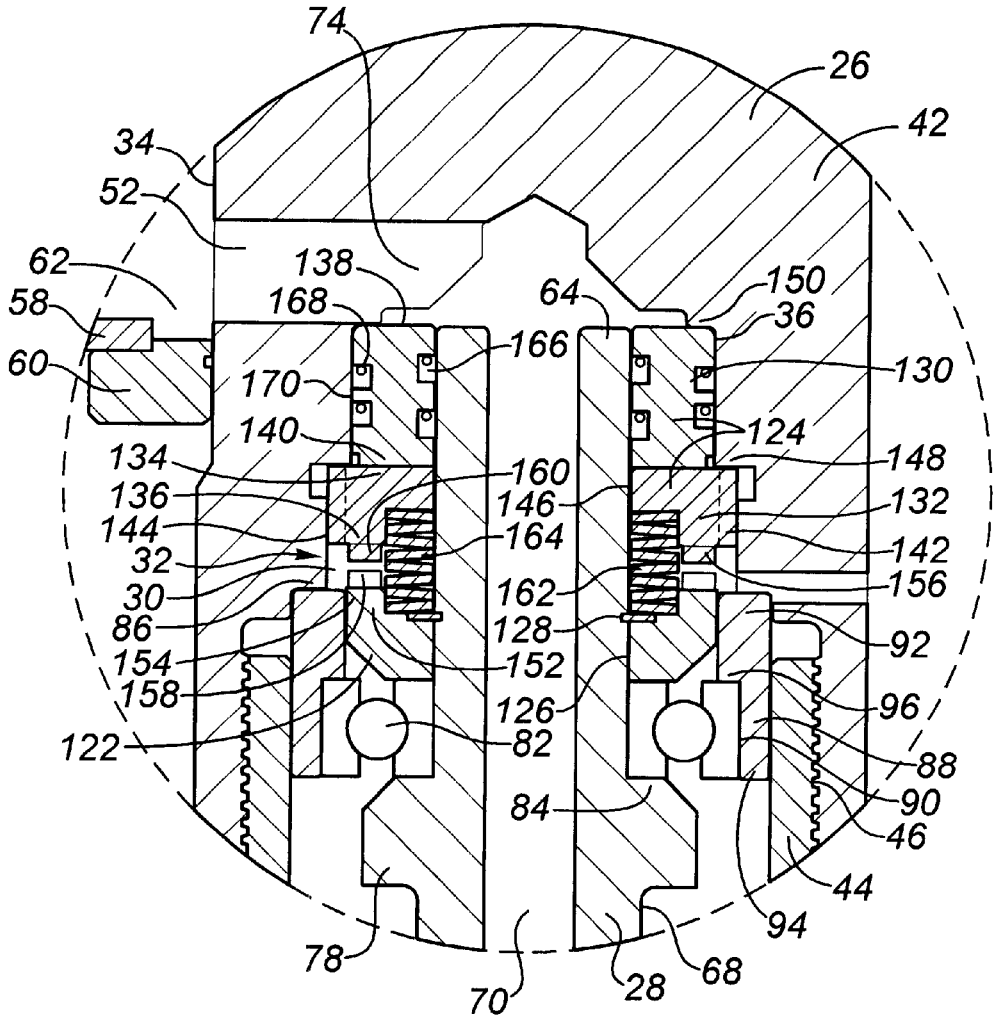
FIG. 5 is a longitudinal sectional view of a portion of the device shown in FIG. 3, wherein a clutch assembly of the device is shown in a disengaged condition.
Figure 6:
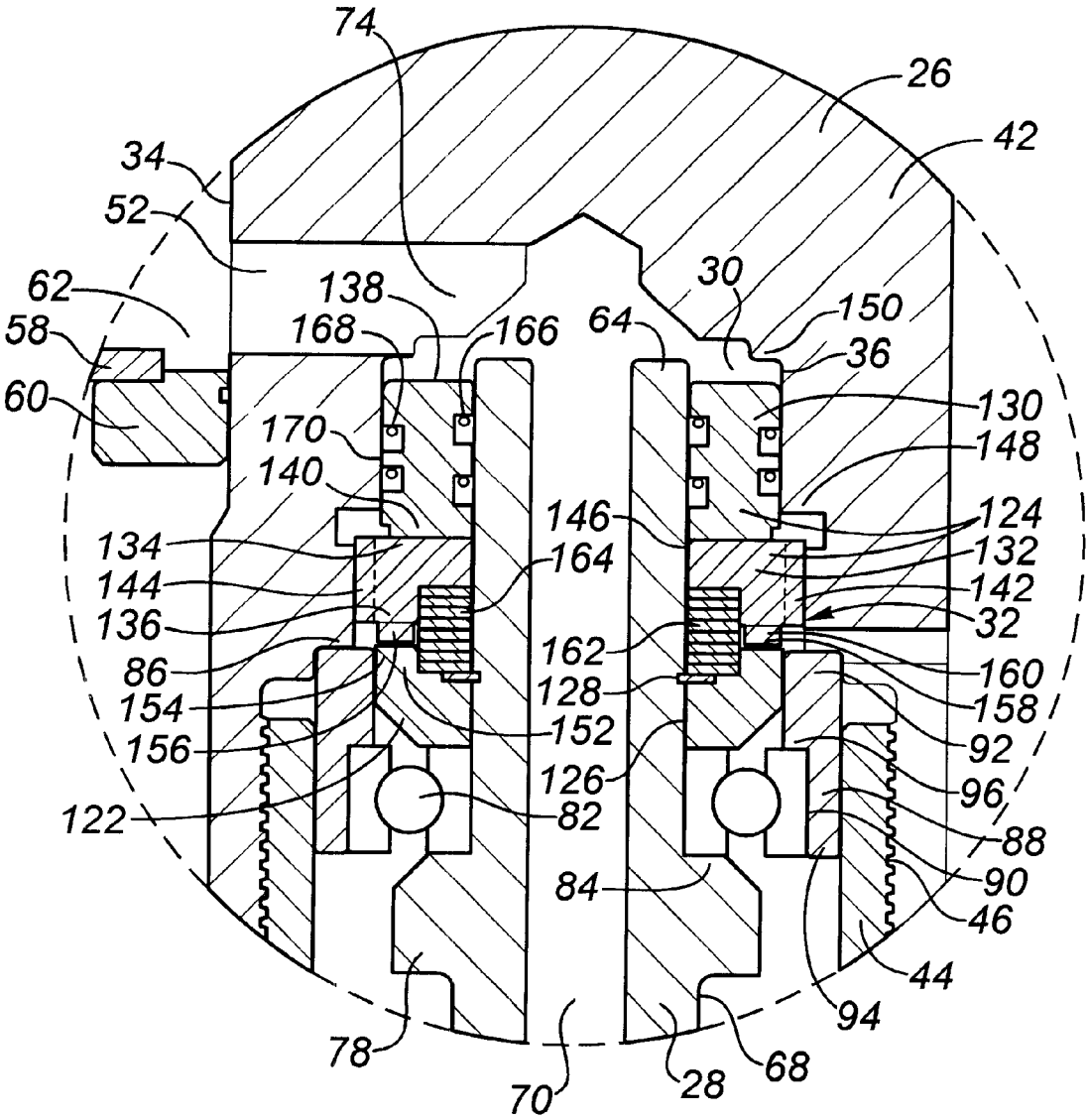
FIG. 6 is a longitudinal sectional view of the portion of the device shown in FIG. 5, wherein the clutch assembly is shown in an engaged condition.

Referring to FIGS. 5 and 6, in the preferred embodiment, the stationary member (122) is fixedly mounted with the mandrel (28), and more particularly, with the outer surface (68) of the mandrel (28). The stationary member (122) may be mounted by any mechanism, structure, device or process capable of fixing the stationary member (122) in position relative to the mandrel (28) such that the stationary member (122) is not movable thereon either longitudinally or axially. Thus, when the clutch assembly (32) is in the disengaged condition, the stationary member (122) rotates with the mandrel (28) relative to the housing (26). In addition, in the preferred embodiment, the stationary member (122) is positioned above the radial bearing (82) and is substantially contained within the bearing housing (88).

Further, the stationary member (122) may extend about any portion or area of the annular space (30) about the outer surface (68) of the mandrel (28). However, preferably, the stationary member (122) extends circumferentially about the entire annular space (30). Thus, in the preferred embodiment, the stationary member (122) defines a bore (126) for receiving the mandrel (28) therein such that the stationary member (122) is fixedly mounted about the outer surface (68) of the mandrel (28). The stationary member (122) is preferably maintained within the bearing housing (88) and fixedly mounted with the mandrel (28), at least in part, by a snap ring (126).

In the preferred embodiment, the dynamic member (124) is movably mounted with the housing (26), and more particularly, with the inner surface (36) of the housing (26). The dynamic member (124) may be mounted to the housing (26) by any mechanism, structure, device or process permitting the dynamic member (124) to move or slide longitudinally within the annular space (30) relative to the housing (26) towards and away from the stationary member (122).

The dynamic member (124) may be comprised of a single unit or element or may be comprised of two or more sections or elements acting together to perform the function of the dynamic member (124). Further, where the dynamic member (124) is comprised of greater than one section or element, the sections or elements may be fixed, connected, mounted or attached together to act as a single unit or they may remain separate and apart while acting in concert or together to perform the function of the dynamic member (124).

In the preferred embodiment, the dynamic member (124) is comprised of an upper piston section (130) and a lower engagement section (132). The lower engagement section (132) has a proximal end (134) and a distal end (136). Similarly, the upper piston section has a proximal end (138) and a distal end (140). Preferably, the pressure of the drilling fluid is communicated to the proximal end (138) of the upper piston section (130). The distal end (140) of the upper piston section (130) abuts or engages the proximal end (134) of the lower engagement section (132), while the distal end (136) of the lower engagement section (132) is provided for engagement with the stationary member (122). Thus, upon the communication of the pressure from the drilling fluid to the upper piston section (130), the upper piston section (130) acts upon the lower engagement section (132) to move the lower engagement section (132) towards the stationary member (122) for engagement therewith.

Thus, both the upper piston section (130) and the lower engagement section (132) of the dynamic member (124) are longitudinally or axially movable within the annular space (30). Further, at least the lower engagement section (132) is mounted with the inner surface (36) of the housing (26) in a manner inhibiting the rotation of the housing (26) or movement of the housing (26) circumferentially relative to the section (132). Thus, when the clutch assembly (32) is in the disengaged condition, at least the lower engagement section (132) rotates with the housing (26) relative to the mandrel (26). To move to the engaged condition, the lower engagement section (132) slides or moves longitudinally along the inner surface (36) of the housing (26) towards the stationary member (122).

The lower engagement section (132) may be movably mounted by any structure, mechanism, device or process permitting the longitudinal movement of the section (132) within the annular space (30) while inhibiting the rotational movement of the housing (26) relative to the section (132). However, in the preferred embodiment, the dynamic member (124), particularly at least the lower engagement section (132), includes a splined outer surface (142) or a keyed outer surface which is compatible with an adjacent splined portion (144) or slotted portion of the inner surface (36) of the housing (26). Engagement of the compatible splined or keyed and slotted surfaces (142, 144) inhibits the rotational movement of the housing (26) relative to at least the lower engagement section (132) of the dynamic member (124).

Further, the dynamic member (124), and each of the upper piston section (130) and the lower engagement section (132), may extend about any portion or area of the annular space (30) within the inner circumference or inner surface (36) of the housing (26). However, the dynamic member (124), and particularly the lower engagement section (132), must be positioned adjacent the stationary member (122) such that the lower engagement section (132) is movable towards the stationary member (122) for engagement therewith. In the preferred embodiment, in order to maximize the engagement between the lower engagement section (132) and the stationary member (122) in the engaged condition of the clutch assembly (32), at least the lower engagement section (132) extends circumferentially about the entire annular space (30). Preferably, both the upper piston section (130) and the lower engagement section (132) extend circumferentially about the entire annular space (30).

Thus, in the preferred embodiment, the dynamic member (124), including both the upper piston section (130) and the lower engagement section (132), defines a bore (146) for receiving the mandrel (28) therein such that the dynamic member (124) is positioned about the outer surface (68) of the mandrel (28). However, the mandrel (28) is permitted to move freely both longitudinally and rotationally within the bore (146) of the dynamic member (124).

When positioned about the mandrel (28), longitudinal movement of the lower engagement section (132) of the dynamic member (124) in a downward or distal direction is limited by the engagement of the distal end (136) of the lower engagement section (132) with the stationary member (122). Longitudinal movement of the lower engagement section (132) of the dynamic member (124) in a upward or proximal direction is limited by one or both of the engagement of the proximal end (134) of the lower engagement section (132) with the distal end (140) of the upper piston section (130) and the engagement of the proximal end (134) of the lower engagement section (132) with a first downwardly directed retention shoulder (148) provided by the inner surface (36) of the housing (26).

Longitudinal movement of the upper piston section (130) of the dynamic member (124) in a downward or distal direction is limited by the engagement of the distal end (140) of the upper piston section (130) with the proximal end (134) of the lower engagement section (132). Longitudinal movement of the upper piston section (130) of the dynamic member (124) in a upward or proximal direction is limited by the engagement of the proximal end (138) of the upper piston section (130) with a second downwardly directed retention shoulder (150) provided by the inner surface (36) of the housing (26).

Further, the stationary member (122) has a proximal end (152) which defines an engagement surface (154). Similarly, the distal end (136) of the lower engagement section (132) of the dynamic member (124) defines a corresponding engagement surface (156). When the clutch assembly (32) is in the engaged condition, the engagement surface (154) of the stationary member (122) is engaged with the engagement surface (156) of the dynamic member (124). As a result, rotation of the mandrel (28) which is fixed with the stationary member (122) is inhibited relative to the housing (26) which is fixed with the lower engagement section (132) by the splines (142, 144) therebetween. Conversely, when the clutch assembly (32) is in the disengaged condition, the engagement surface (154) of the stationary member (122) is disengaged from the engagement surface (156) of the dynamic member (124) such that rotation of the mandrel relative to the housing is permitted.

The engagement surface (154) of the stationary member (122) and the engagement surface (156) of the dynamic member (124) may have any compatible shapes or configurations able to inhibit, and preferably prevent, the rotation of the stationary member (122) relative to the dynamic member (124) and thus, the rotation of the mandrel (28) relative to the housing (26), when engaged. However, preferably, the engagement surface (154) of the stationary member (122) defines a plurality of stationary teeth (158) and the engagement surface (156) of the dynamic member (124) defines a plurality of corresponding dynamic teeth (160) compatible with the stationary teeth (158) for engagement therewith.

In the preferred embodiment, the stationary and dynamic teeth (158, 160) are shaped or configured such that rotation of the stationary member (122) relative to the dynamic member (124) is inhibited in both clockwise and counterclockwise directions. However, if desired, the stationary and dynamic teeth (158, 160) may be shaped or configured such that rotation of the stationary member (122) relative to the dynamic member (124) is inhibited in only one of a clockwise and a counterclockwise direction. For instance, the stationary and dynamic teeth (158, 160) may be sloped to inhibit relative rotation in the direction necessary to counteract the reactive torque of the downhole motor, while permitting relative rotation in the opposite direction.

Further, as indicated above, the clutch assembly (32) is biased towards the disengaged condition. More particularly, in the preferred embodiment, the dynamic member (124) is biased away from the stationary member (122). Thus, the clutch assembly (32) is preferably further comprised of a biasing device (162) associated with the dynamic member (124) for urging the dynamic member (124), and particularly the lower engagement section (132), away from the stationary member (122) such that the engagement surface (154) of the stationary member (122) disengages the engagement surface (156) of the dynamic member (124).

The biasing device (162) may be comprised of any device, mechanism or structure capable of urging the engagement surface (154) of the stationary member (122) away from the engagement surface (156) of the dynamic member (124). However, in the preferred embodiment, the biasing device (162) is comprised of at least one spring (164), preferably a disk spring, located between the stationary and dynamic members (122, 124). More particularly, the spring (164) is positioned between the proximal end (152) of the stationary member (122) and the distal end (136) of the lower engagement section (132), wherein movement of the engagement surfaces (154, 156) towards each other compresses the spring (164). Further, the spring (164) is selected to have a spring force sufficient to urge the dynamic member (124) away from the stationary member (122) to the disengaged condition when the pressure is not being exerted by the drilling fluid.

As indicted previously, the tapered bearing (76) is preferably preloaded within the annular space (30). In the preferred embodiment, the tapered bearing (76) is preloaded by the spring force of the spring (164) comprising the biasing device (162). Thus, the spring (164) is further preferably selected to have a spring force sufficient to provide the desired preloading force to the tapered bearing (76). Specifically, given that the spring (164) is compressed between the engagement surfaces (154, 156), the spring (164) both urges the dynamic member (124) in an upwards or proximal direction and urges the stationary member (122) in a downwards or distal direction. Given that the stationary member (122) is fixedly mounted with the mandrel (28), the urging of the stationary member (122) by the spring (164) results in the urging of the mandrel downwards or distally. Accordingly, the downwardly facing bearing shoulder (78) of the mandrel (28) is urged towards the upwardly facing bearing shoulder (80) of the housing (26) such that the tapered bearing (76) is compressed therebetween to apply the preloading force.

Finally, the swivel device (20) is preferably further comprised of a sealing assembly for sealing the annular space (30) in order to inhibit the entry of the drilling fluid therein. Preferably, one or more seals are provided about the dynamic member (124) for sealing the annular space (30) adjacent the fluid chamber (74). Specifically, one or more seals are provided between the dynamic member (124) and the adjacent inner surface (36) of the housing (26) and outer surface (68) of the mandrel (28).

In the preferred embodiment, at least one inner seal (166), preferably a polypac seal, is provided between the bore (146) of the upper piston section (130) of the dynamic member (124) and the adjacent outer surface (68) of the mandrel (28) at the proximal end (64) of the mandrel (28). Similarly, at least one outer seal (168), preferably a polypac seal, is provided between an outer surface (170) of the upper piston section (130) of the dynamic member (124) and the adjacent inner surface (36) of the housing (26). As a result, drilling fluid is inhibited from passing from the fluid chamber (74) past the upper piston section (130) of the dynamic member (124) into the annular space (30).

As well, the annular space (30) is preferably filled with a lubricant for lubricating the clutch assembly (32) and the bearing assembly within the annular space (30). The sealing assembly described above assists in the retention of the lubricant within the annular space (30) and specifically inhibits the passing of any lubricant out of the uppermost or proximal end of the annular space (30) past the upper piston section (130) of the dynamic member (124). Further, at least one seal (172) is preferably provided at the lowermost or distal end of the annular space (30) between the mandrel (28) and the housing (26). Specifically, the seal (172) is positioned between the outer surface (68) of the mandrel (28) and the inner surface (36) of the housing (26) at the distal end (40) of the housing (26). The seal (172) further assists in the retention of the lubricant within the annular space (30) and specifically inhibits the passing of any lubricant out of the lowermost or distal end of the annular space (30).

As well, one or more passages may be provided through the housing (26) to permit the introduction of the lubricant into the annular space (30). For instance, in the preferred embodiment, the distal end (40) of the housing (26) defines a first lubricant passage (174) extending through the housing (26) to the annular space (30) adjacent the tapered bearing (76). The first lubricant passage (174) preferably includes a zerk fitting (176) to retain the lubricant within the annular space (30). In addition, the housing (26) defines a second lubricant passage (178) extending from the outer surface (34) of the housing (26), through the housing (26) to the annular space (30) adjacent the spring (164). The second lubricant passage (178) may similarly include a zerk fitting (not shown).

The embodiments of the invention in which an exclusive privilege or property is claimed are defined as follows:

1. A locking swivel device for connection with a proximal end of a drill string and for conducting a drilling fluid to the drill string, the device comprising:

(a) a housing having an inlet for conducting the drilling fluid therein;

(b) a mandrel rotatably supported within the housing such that an annular space is defined between the housing and the mandrel, wherein a pressure exerted by the drilling fluid is communicated to the annular space and wherein one of the housing and the mandrel is connectable with the drill string such that the drill string rotates therewith and such that the drilling fluid is conducted to the drill string; and (c) a clutch assembly within the annular space and actuatable between an engaged condition in which the clutch assembly engages the housing and the mandrel in order to inhibit the rotation of the mandrel relative to the housing and a disengaged condition in which the clutch assembly disengages the housing and the mandrel in order to permit the rotation of the mandrel relative to the housing, wherein the communication of an actuation pressure exerted by the drilling fluid to the annular space actuates the clutch assembly to the engaged condition.

2. The swivel device as claimed in claim 1 wherein the clutch assembly is biased towards the disengaged condition such that the clutch assembly is actuated to the disengaged condition when the actuation pressure is not being exerted by the drilling fluid.

3. The swivel device as claimed in claim 2 wherein the mandrel is conectable with the drill string such that the mandrel and the drill string rotate relative to the housing.

4. The swivel device as claimed in claim 3 wherein the mandrel defines a bore, wherein the inlet communicates with the bore of the mandrel and wherein the bore of the mandrel communicates with the drill string in order that the drilling fluid may be conducted through the mandrel to the drill string.

5. The swivel device as claimed in claim 4 wherein the housing defines a fluid chamber associated with the inlet, wherein the pressure of the drilling fluid within the fluid chamber is communicated to the annular space to actuate the clutch assembly.

6. The swivel device as claimed in claim 5 wherein the fluid chamber conducts the drilling fluid from the inlet to the bore of the mandrel.

7. The swivel device as claimed in claim 6 further comprising an anti-rotation device associated with the housing for inhibiting the rotation of the housing such that the housing is substantially stationary in order that the mandrel is rotatable within the stationary housing when the clutch assembly is disengaged and the mandrel and the housing are substantially stationary when the clutch assembly is engaged.

8. The swivel device as claimed in claim 4 wherein the clutch assembly is comprised of a stationary member associated with one of the housing and the mandrel and a dynamic member associated with the other of the housing and the mandrel, wherein the dynamic member is movable within the annular space towards the stationary member for engagement therewith to actuate the clutch assembly to the engaged condition and away from the stationary member for disengagement therefrom to actuate the clutch assembly to the disengaged condition.

9. The swivel device as claimed in claim 8 wherein the stationary member is fixedly mounted with one of the housing and the mandrel and the dynamic member is movably mounted with the other of the housing and the mandrel.

10. The swivel device as claimed in claim 9 wherein the pressure of the drilling fluid is communicated to the dynamic member within the annular space such that the actuation pressure exerted by the drilling fluid moves the dynamic member towards the stationary member for engagement therewith.

11. The swivel device as claimed in claim 10 wherein the dynamic member is biased away from the stationary member such that the dynamic member is moved away from the stationary member for disengagement therefrom when the actuation pressure is not being exerted by the drilling fluid.

12. The swivel device as claimed in claim 11 wherein the clutch assembly is further comprised of a biasing device associated with the dynamic member for urging the dynamic member away from the stationary member for disengagement therefrom.

13. The swivel device as claimed in claim 12 wherein the housing defines a fluid chamber associated with the inlet, wherein the pressure of the drilling fluid within the fluid chamber is communicated to the dynamic member within the annular space.

14. The swivel device as claimed in claim 13 wherein the fluid chamber conducts the drilling fluid from the inlet to the bore of the mandrel.

15. The swivel device as claimed in claim 14 further comprising an anti-rotation device for inhibiting the rotation of the housing such that the housing is substantially stationary in order that the mandrel is rotatable within the stationary housing when the clutch assembly is disengaged and the mandrel and the housing are substantially stationary when the clutch assembly is engaged.

16. The swivel device as claimed in claim 14 wherein the biasing device is comprised of at least one spring and wherein the spring has a spring force sufficient to urge the dynamic member away from the stationary member to the disengaged condition when the actuation pressure is not being exerted by the drilling fluid.

17. The swivel device as claimed in claim 14 wherein the stationary member is fixedly mounted with the mandrel and the dynamic member is movably mounted with the housing.

18. The swivel device as claimed in claim 17 wherein the stationary member defines a bore for receiving the mandrel therein such that the stationary member is mounted about an outer surface of the mandrel and wherein the dynamic member defines a bore for receiving the mandrel therein such that the dynamic member is positioned about the outer surface of the mandrel and mounted with an inner surface of the housing.

19. The swivel device as claimed in claim 14 wherein the stationary member has an engagement surface and the dynamic member has a corresponding engagement surface, wherein the engagement surface of the stationary member is engaged with the engagement surface of the dynamic member in the engaged condition of the clutch assembly such that rotation of the mandrel relative to the housing is inhibited and wherein the engagement surface of the stationary member is disengaged from the engagement surface of the dynamic member in the disengaged condition of the clutch assembly such that rotation of the mandrel relative to the housing is permitted.

20. The swivel device as claimed in claim 19 wherein the engagement surface of the stationary member defines a plurality of stationary teeth and wherein the engagement surface of the dynamic member defines a plurality of corresponding dynamic teeth compatible with the stationary teeth for engagement therewith.

21. The swivel device as claimed in claim 14 further comprising a bearing assembly within the annular space for axially and radially supporting the mandrel within the housing such that the mandrel is rotatable therein.

22. The swivel device as claimed in claim 21 wherein the bearing assembly is comprised of at least one tapered bearing.

23. The swivel device as claimed in claim 22 wherein the mandrel defines a downwardly facing bearing shoulder, wherein the housing defines an upwardly facing bearing shoulder and wherein the tapered bearing is positioned therebetween such that the mandrel is rotatably supported by the housing.

24. The swivel device as claimed in claim 21 wherein the bearing assembly is comprised of at least one radial bearing.

25. The swivel device as claimed in claim 23 wherein the biasing device is comprised of at least one spring and wherein the spring has a spring force sufficient to urge the dynamic member away from the stationary member to the disengaged condition when the actuation pressure is not being exerted by the drilling fluid.

26. The swivel device as claimed in claim 25 wherein the tapered bearing is preloaded by the spring force of the spring comprising the biasing device.

27. The swivel device as claimed in claim 14 further comprising a sealing assembly for sealing the annular space in order to inhibit the entry of the drilling fluid therein.

* * * * *